ALBUM COVER DISPLAY FRAME

BACKGROUND OF THE INVENTION

1. Field of the Invention

The invention relates to card, picture, and sign exhibiting, and particularly to picture frames that may be embossed, rolled, or stamped; extensible, folding or knockdown; with card or picture retainers. Specifically, the invention relates to a display frame for phonograph record covers that permits the repeated and rapid insertion and removal of the covers.

2. Description of the Prior Art

Picture frames have in the past been designed with the goals of firmly retaining the picture and engaging pictures of any of various sizes or thicknesses. In some areas of the art, such as name plate or sign frames, it has been desired that the contents of the frame be removeable, although such removal would be only periodic at best, and it has been considered undesirable the removal be overly easy, as this might encourage unauthorized removal. U.S. Pat. No. 3,918,187 to Vogele discloses a flexible plastic rectangular frame for displaying signs, wherein the contents of the frame can be removed by flexing the frame to unhook it from a backing plate, after which the contents is removed from the rear of the frame. U.S. Pat. No. 3,668,799 to Sharron and U.S. Pat. No. 3,613,280 to Tuchinsky teach frames that are assembled by uniting straight frame sections onto right angled corner pieces. A flexible clip or hook associated with the frame holds the sign or picture having any of various thicknesses. U.S. Pat. No. 2,882,633 to Howell and U.S. Pat. No. 2,744,346 to Auerbach-Levy teach spring loaded clamps for retaining posters in a frame.

The problem common to all of the above frames and clamping devices with respect to the purposes of the present invention is that the picture or sign placed in the frame is intended to be retained on a relatively permanent basis. The reason for this is, of course, that most signs or pictures have value only as display items and not in other utilitarian ways. The present invention provides a frame for frequently removed articles, as will be disclosed.

SUMMARY OF THE INVENTION

A display and storage frame for frequently removed objects includes a rectangular planar base having an adhesive coating on the rear face thereof to support the frame on a wall. On the front face near the outer perimeter of the base is a forwardly extending lip having a greater height than the intended thickness of the object to be carried therein. At least one retaining tab extends inwardly from each side of the frame at the top of the lip, and at least one of the tabs overlies a lifting finger formed in the base and connected to the tab through the lip, which may be severed at each longitudinal end of the tab for the height of the lip. When the object stored in the frame is to be removed, the tab is drawn outwardly from the frame, flexing the attached portion of the lip outwardly and causing the finger to extend upwardly, raising the object above the base for immediate removal.

An object of the invention is to create a device for the storage and display of phonograph record in their covers, permitting simplified insertion and removal of the cover from the frame so that use of the frame will be substantially as convenient as use of known record racks.

Another object is to create a storage frame for record albums that will prevent the contained phonograph records from warping.

A further object is to create a display frame from plastic materials that can be extruded or molded to form the frame from a plurality of identical pieces that are easily interlocked to form perfect right angles at corners.

DESCRIPTION OF THE PREFERRED EMBODIMENT

Figure 1:
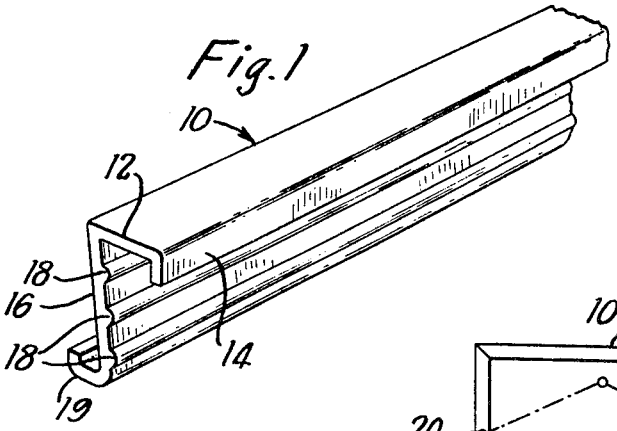
FIG. 1 is a front view of the frame.

The invention is best shown in FIG. 1 to be a display frame 10 having a rectangular or square outer perimeter 12. The frame is especially adapted to display phonograph record album covers, which are often created with attractive and artistic cover pictures. The usual phonograph record album cover is a square having sides approximately 12¼ to 12½ inches in length, although the frame could be adapted to other sizes without altering the concept of its operation. In FIG. 1 the frame is also known to have a square inner perimeter 14 with diagonally truncated corners 16. The configuration of the inner perimeter is variable in that the entire inner perimeter may be eliminated in favor of a solid backing sheet or an intermediate compromise between the illustrated configuration and the solid sheet.

Figure 2:
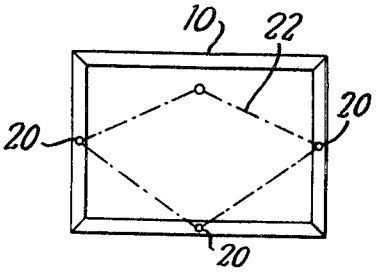
FIG. 2 is a front view of one side member of the frame.
Figure 3:
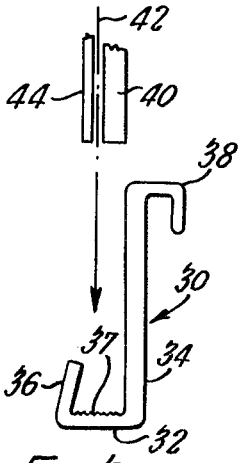
FIG. 3 is a side view of the side member of FIG. 1.
Figure 4:
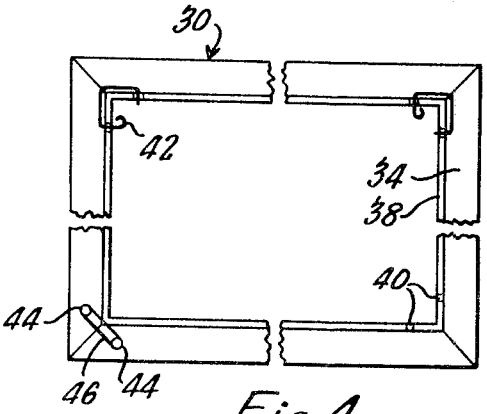
FIG. 4 is a fragmentary isometric view of one keeper tab and finger.
Figure 5:
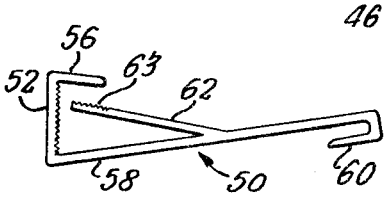
FIG. 5 is a cross-sectional view taken along the plane of line 5—5 of FIG. 1.
Figure 1:
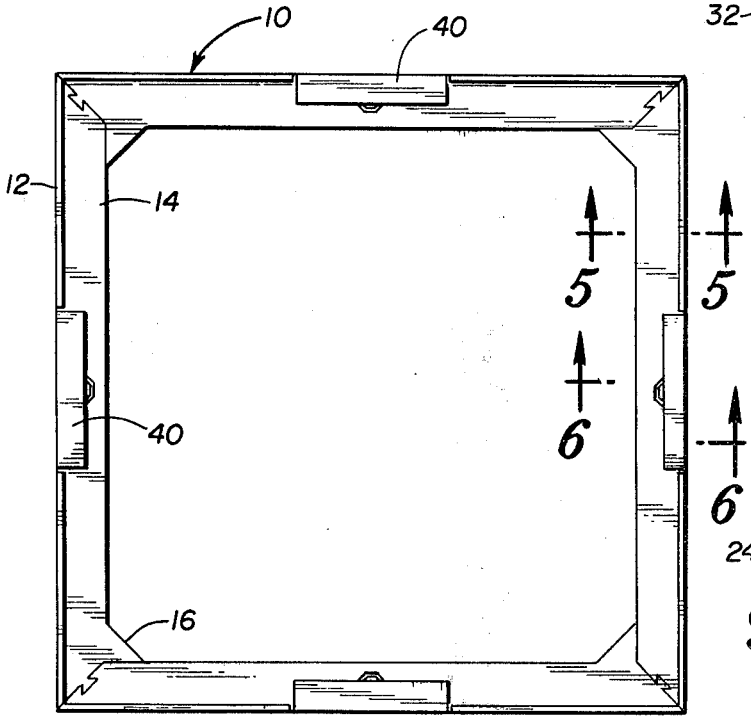
Figure 2:
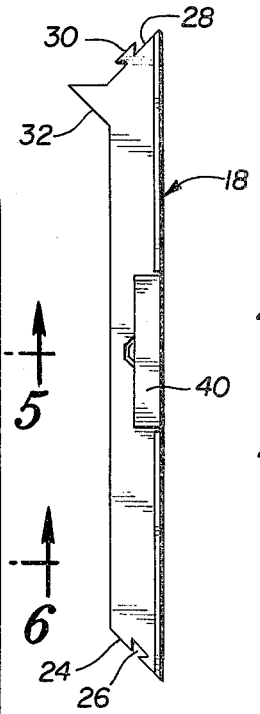
Figure 3:
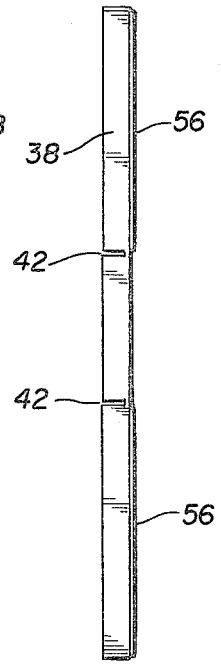
Figure 4:
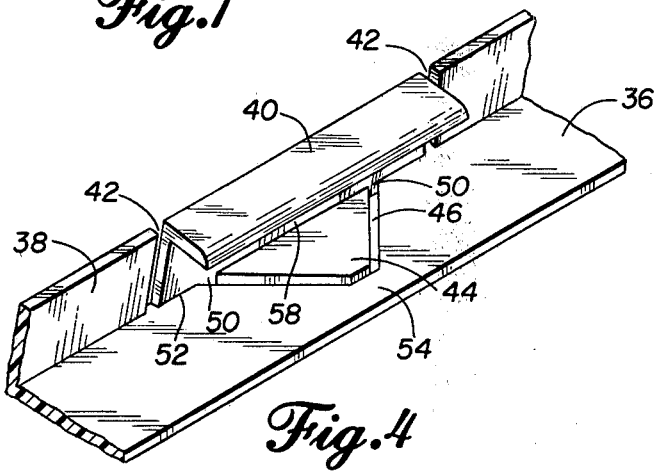
Figure 5:
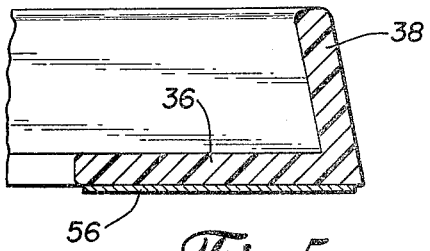

In the illustrated configuration, the square frame may be formed from four identical side members 18, best shown in FIG. 2 to include a straight outer surface 20, a straight parallel inner surface 22, a first end surface 24 connecting 20 and 22 at an acute angle such as 45 degrees and having a joining means such as dovetail slot 26 at a suitable position along its length. The side member 18 also has a second end surface 28 connecting sides 20 and 22 at an acute angle that, together with the angle of end 24 adds to 90 degrees. A complimental joining means such as dovetail 30 is positioned to engage the slot 26 of another adjacent side member. A corner brace 32 may be connected to surface 22 immediately adjacent to end 28, with an outer edge 34 perpendicular to surface 22 and positioned to abut the inner edge 22 of another side member 18 connected to end 28. The corner brace in this manner forms the truncated corner of the inner perimeter and supports the two connected side members at a right angle.

With reference now to FIGS. 1–8, each side member includes both a planar base 36 and an upstanding lip or flange 38 preferably located along the outside edge of the base at the outer perimeter 12. The lip extends upwardly from the base for a sufficient height to contain a record album cover, which is usually less than one-quarter inch thick. Although the lip may be perpendicular to the base, the best album cover retention results when the lip is at a slightly acute inside angle, such as 80 degrees shown in FIG. 5. The lip may encompass substantially the entire perimeter of the complete frame 10. At least in two of the side members 18 and preferably in all four, a retaining tab or keeper 40 extends inwardly from the top of the lip at selected locations for the purpose of overlying the album cover to retain the cover in the frame. At least one tab 40 and preferably all four such tabs are attached to a lip portion that is laterally severed from adjacent lip portions by grooves 42 extending from base 36 to the full height of the lip. Connected to the lip under the keeper tab is a lifting finger 44 spaced sufficiently far below the tab to permit the thickness of the contained album cover therebetween. The finger may be formed from the base by means of a slot 46 having its opposite ends 50 near the intersection 52 of the base and the lip and spaced mutually between the grooves 42 so that an unbroken segment of the intersection 52 lies between each groove 42 and the end 50 of the slot 46 nearest to the groove to serve as a pivot axis. In the drawings, the slot 46 is illustrated to be in the shape of a V or a U extending inwardly from the lip for a distance shorter than the inward dimension of the base defining a trapezoidal finger, with the result that a portion 54 of the base at the inner perimeter of the frame remains unbroken and connects the base for the full length of each side member 18. Optionally the finger 44 may be extended inwardly for the full width of the base to define a rectangular finger, resulting in the base portion 54 being eliminated and the slot 46 becoming two slots opening to the inside of the base.

For convenience of assembling and mounting the frame to a wall, the lower surface of the base carries an adhesive coating 56, although no such coating is desired under the finger 44. A known preferred coating is a pressure sensitive adhesive of the type applied on a spongy resilient tape and covered by a protective, removable gloss paper.

For the suggested purpose of displaying stiff album covers, the frame may be constructed from a flexible, resilient plastic material such as polyethylene having a sheet thickness of $\frac{1}{8}$ inch. Each side member may be formed with the base having a one inch width and $12\frac{3}{4}$ inch maximum length. The inward facing edge of each corner bracket may be one inch. Lip 38 extends for the length of the base and for $\frac{1}{2}$ inch in height, measured from the bottom of the base. Each keeper tab has a length of 3 inches in the center of the lip and a width of $\frac{1}{4}$ inch, measured from the outer face of the lip. If the top surface of the keeper tab is coplanar with the top of the lip, then an album cover receiving space of $\frac{1}{4}$ inch remains between the bottom of the tab and the top of the base. The keeper tabs may be perpendicular to the lip, with the result that each tab angles inwardly and downwardly at ten degrees below the plane of the base. Each finger may have a union 58 of one inch in length between the outer edge of the finger and the lip.

In operation, the frame is assembled by removing the glossy protective paper from the adhesive of each side member and applying the members to a wall or other flat surface of choice. The dovetail ends and corner braces permit the side members to be interconnected accurately and quickly to form a perfect square. The members may be assembled into the square prior to removal of the protective paper and the entire frame applied to the wall in a single action. After the frame is in position, a record album cover is inserted by sliding the cover between two opposite tabs 40 from a common side, while pulling the tab under the approaching cover to the outside to remove that tab from its position overlying the base. The cover then slides under the three unmoved tabs and may be placed against the base. Upon release of the pulled-back tab, this tab resiliently returns to its original position, now overlying a portion of the album cover and completing a four sided retainer holding the cover in the frame.

Figure 7:
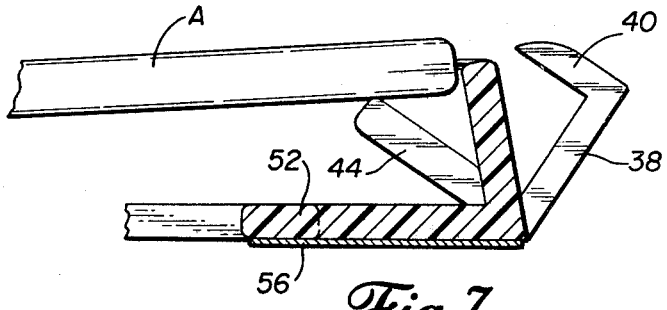
Figure 6:
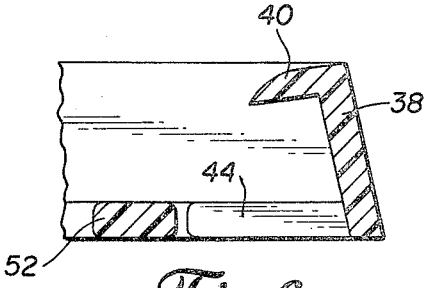
FIG. 6 is a cross-sectional view taken along the plane of line 6—6 of FIG. 1.

Removal of the album cover is best illustrated in FIG. 7, showing one of the tabs again drawn outwardly. Because the material of construction is flexible, the outward motion of the tab 40 and its attached portion of lip 38 also results in the finger 44 pivoting along the intersection 52 of the lip and base. As the finger pivots, it raises the album cover A, permitting the edge of the cover to be grasped for removal by sliding outwardly over the withdrawn tab.

From the description provided above, it should be evident that the frame 10 permits an album cover to be quickly and repeatedly inserted and removed. The frame serves as a storage device for the cover either with or without its contained phonograph record, permits the cover to be displayed for appreciation of its decorative art work, and provides four sided support to the cover to prevent the record from warping, as often happens when the record and its cover are stored in a rack. The insertion and removal are sufficiently simple that use of the frame does not discourage use of the displayed record, as might be the case with a more difficult retention system.

While the above description attempts to indicate those areas of construction where variations might be expected, it should be understood that the description is offered for purposes of example and not for limitation.

I claim:

1. A frame for the display and rapid removal of a stiff planar display object, comprising:

(a) a base lying substantially in a plane and defining an outer perimeter of the frame;

(b) at least four lips extending from a first face of the base plane and defining a central area for containing the display object;

(c) a keeper tab connected to each of said lips and extending toward said central area therefrom, spaced from said first face of the base plane and defining between said tab and first face a space for receiving, in use, a thickness of a stiff planar display object;

(d) at least one lifting finger associated with a lip and keeper tab, connected to said lip, and extending toward said central area therefrom, substantially in said base plane; and (e) an integral junction between the lip associated with the lifting finger and the base, the base and lip being formed of a resilient, flexible compositional material, such that movement of the keeper tab outwardly with respect to said outer perimeter is transmitted through said compositional material to simultaneously lift a portion of the lifting finger to, in use, urge the display object away from the base.

2. The frame of claim 1, wherein said lips are at an acute inside angle to the planar base.

3. The frame of claim 2, wherein said acute angle is 80 degrees.

4. The frame of claim 1, wherein :

(a) said planar base comprises a square;

(b) each of said lips extends forwardly from one edge of the outer perimeter of the square base; and (c) said associated keeper tab is connected to its lip near the center of one edge of the square and is bounded by a groove on both perimetric ends thereof extending through the lip at least to the height of the finger.

5. The frame of claim 4, wherein said lifting finger underlies the associated keeper tab, said compositional material is a plastic material, and said junction between the lip and base comprises an integral connection between the outer edge of the lifting finger and the inner face of the associated lip between said grooves.

6. The frame of claim 5, wherein said finger is coplanar with said base and defined therefrom by a slot through the base having terminal ends near the junction of the base and lip and spaced mutually between said grooves.

7. The frame of claim 6, further comprising adhesive means on the rear face of said planar base.

8. A frame of flexible plastic material for the display and rapid removal of a stiff planar display object, comprising:

(a) four substantially identical elongated side members unitable to form a square, each of the side members having a planar base with inward and outward longitudinal edges and first and second end edges, said longitudinal edges being mutually parallel and said first and second end edges being diagonal to the longitudinal edges and mutually perpendicular, the first end having a dovetail slot and the second end having a dovetail tab.

(b) each member having a lip extending from the forward side of the base at the outward longitudinal edge thereof, and an inwardly extending keeper tab at the top of the lip near the center thereof and for only a fraction of the longitudinal length of the outward edge, the lip having bounding grooves at the opposite ends of the keeper tab extending substantially the full height of the lip above the base; and (c) the base under each keeper tab having a finger formed therein with an integral union between the finger and the lip, the finger being defined from the base on other sides by a severance ending near the lip at a longitudinal spacing from said grooves to create a pivot area between the severance and the grooves.

9. The frame of claim 8, further comprising a triangular corner brace on the inward longitudinal edge of said planar base at the intersection of the inward edge and one of the first and second edges.

10. The frame of claim 8, further comprising an adhesive coating on the rearward side of the planar base for retaining the side members in assembled form against a planar surface.

* * * * *